US009320328B1

(12) United States Patent
Sinclair

(10) Patent No.: US 9,320,328 B1
(45) Date of Patent: Apr. 26, 2016

(54) TEXTILE FASTNER

(71) Applicant: Margaret A. Sinclair, Mabank, TX (US)

(72) Inventor: Margaret A. Sinclair, Mabank, TX (US)

( * ) Notice: Subject to any disclaimer, the term of this patent is extended or adjusted under 35 U.S.C. 154(b) by 144 days.

(21) Appl. No.: 13/724,044

(22) Filed: Dec. 21, 2012

(51) Int. Cl.
*A44C 1/00* (2006.01)
*A41D 27/00* (2006.01)

(52) U.S. Cl.
CPC .. *A44C 1/00* (2013.01); *Y10T 24/32* (2015.01); *Y10T 24/44034* (2015.01)

(58) Field of Classification Search
CPC ..... A44C 1/00; Y10T 24/32; Y10T 24/44034
USPC ..... 24/303, 459
See application file for complete search history.

(56) References Cited

U.S. PATENT DOCUMENTS 2,435,082 A * 1/1948 Huber ..... 24/459
2,454,103 A * 11/1948 Swidersky ..... 24/459
2,939,195 A * 6/1960 Carlson ..... 24/459
3,141,216 A * 7/1964 Haskell ..... 24/303
3,865,290 A * 2/1975 Sperling ..... 224/194
4,175,305 A * 11/1979 Gillis ..... 24/459
4,688,304 A * 8/1987 Marcott ..... 24/459
5,033,170 A * 7/1991 Ewert ..... 24/459
5,369,899 A * 12/1994 Reeves ..... 40/1.5
5,511,289 A * 4/1996 Melia ..... 24/66.9
2007/0251062 A1* 11/2007 Saitoh et al. ..... 24/303
2013/0247279 A1* 9/2013 Castillo ..... 2/255
2013/0269156 A1* 10/2013 Fildan et al. ..... 24/303

* cited by examiner

*Primary Examiner* — Robert J Sandy
*Assistant Examiner* — Louis Mercado
(74) *Attorney, Agent, or Firm* — Fogarty, L.L.C.

(57) ABSTRACT

In one example, a textile fastener may include a pegging member, and a receiving member. The receiving member may include a flange portion configured to support at least a portion of the textile, and an opening disposed within the flange portion configured to receive the pegging member. In some cases, the pegging member may be configured to apply a friction force between the textile and the receiving member when the pegging member is inserted into the opening. Magnetic interaction between the pegging member and the receiving member may maintain the friction force between the textile and the receiving member.

13 Claims, 7 Drawing Sheets

TEXTILE FASTNER

TECHNICAL FIELD

Embodiments of the invention are directed, in general, to fasteners and, more specifically, to textile fasteners.

BACKGROUND

Textiles include cloth or fabric which may be used for various purposes including manufacture of clothing, window coverings, furniture coverings, towels, bed sheets, and many others. Textiles are often made by weaving, knitting, crocheting, knotting or pressing natural or artificial fibers together. Textiles can be made from any number of materials, in a variety of colors, by a variety of techniques, and for a variety of purposes.

Clothing is one of the primary uses of textiles. Tailors and dressmakers use textile fabric to make fine dresses and suits. Clothing manufacturers use textile fabric to mass produce shirts, trousers, dresses, and the like. Additionally, simple strips of textile fabric may be used to make scarfs, sarongs, wraps, skirts, shawls, and the like.

Additionally, textiles may be adorned with various ornaments or accessories to enhance the appearance of the textile. For example, ornamental flowers or brooches may be attached to the textile to improve its appearance or add design elements to finished products. Typically such ornaments are sewn or pinned in place.

SUMMARY

Embodiments of the invention are directed to textile fasteners. In some embodiments, a textile fastener may fasten a textile without damaging the textile. For example, the textile fastener may not require penetration the surface or disruption of the weave of the textile with a pin or needle. In certain further embodiments, the textile fastener may include an ornamental element.

In one embodiment, the textile fastener may include a pegging member, and a receiving member. The receiving member may include a flange portion configured to support at least a portion of the textile, and an opening disposed within the flange portion configured to receive the pegging member. In an embodiment, the pegging member may be configured to apply a friction force between the textile and the receiving member when the pegging member is inserted into the opening. In particular, magnetic interaction between the pegging member and the receiving member may maintain the friction force between the textile and the receiving member.

In one embodiment, the receiving member is magnetic. In some embodiments the pegging member may be magnetic. In further embodiments, both the receiving member and the pegging member are magnetic. Alternatively, only one of the pegging member or the receiving member is magnetic.

The receiving member and the pegging member may each be configured in various shapes and arrangements. For example, the receiving member may be a disk. Alternatively, the receiving member may be a block having a slot, wherein the slot is the opening. In other such embodiments, the opening is an aperture in the flange. Alternatively, the opening may be a concave surface having a profile configured to match a surface of the pegging member.

In a further embodiment, the receiving member includes an outer edge, and an inner edge, the inner edge being concentric with the outer edge and defining the opening. In an example embodiment, the pegging member comprises a spherical magnet. In these various embodiments, the textile fastener may include an ornamental structure coupled to the at least one of the pegging member or the receiving member.

In another embodiment, the textile fastener may include a pegging member, and a receiving member. The receiving member may include a flange portion configured to support a first textile layer and a second textile layer, an opening disposed within the flange portion configured to receive the pegging member. The pegging member may be configured to apply a friction force to the receiving member, the first textile layer and the second textile layer for inhibiting movement of the first and second textile layers relative to each other and relative to the receiving member when the pegging member is inserted into the opening. In one embodiment, magnetic interaction between the pegging member and the receiving member is configured to maintain the friction force on the first layer of textile, the second layer of textile, and the receiving member.

Methods for fastening textiles are also described. In one embodiment, the method includes positioning a first layer of textile adjacent to a receiving member of a textile fastener. The receiving member may include a flange portion configured to support a first textile layer and a second textile layer, and an opening disposed within the flange portion configured to receive the pegging member. The method may further include positioning a second layer of textile adjacent to the first layer of textile. A pegging member may be inserted into the opening, such that the first layer of textile and the second layer of textile are pinned between the pegging member and the receiving member in the area of the opening. In such an embodiment, the pegging member is configured to apply a friction force to the receiving member, the first textile layer and the second textile layer for inhibiting movement of the first and second textile layers relative to each other and relative to the receiving member when the pegging member is inserted into the opening. Additionally, magnetic interaction between the pegging member and the receiving member is configured to maintain the friction force on the first layer of textile, the second layer of textile and the receiving member.

BRIEF DESCRIPTION OF THE DRAWINGS

Figure 1:
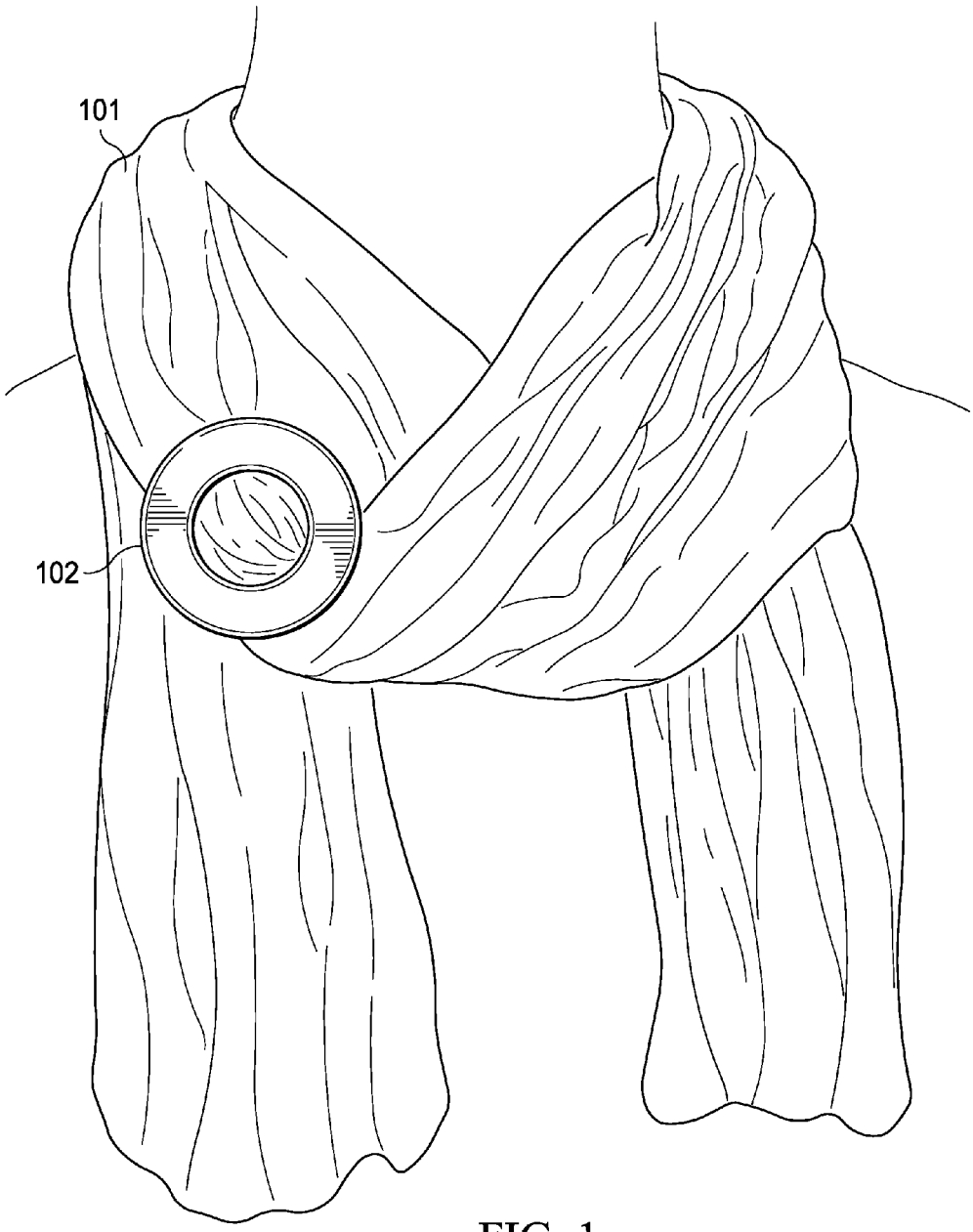

Having thus described the invention in general terms, reference will now be made to the accompanying drawings, which are not necessarily drawn to scale, and wherein:

FIG. 1 is an illustration of a textile with an ornamental fastener.

Figure 2:
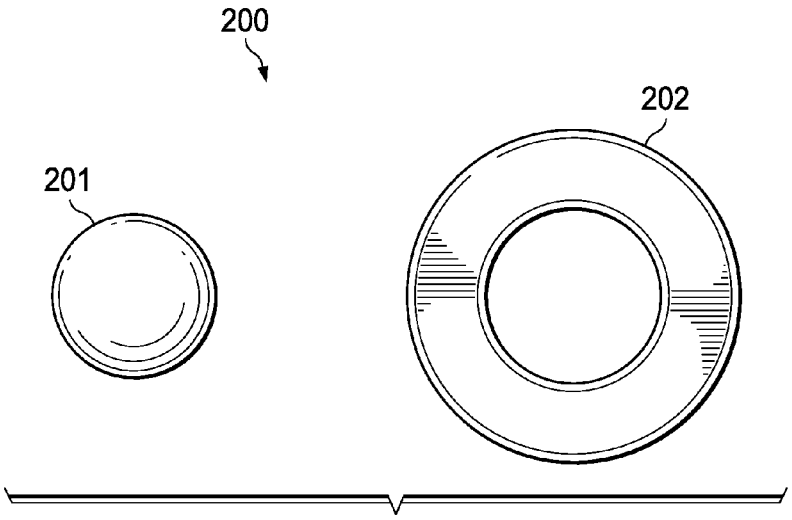

FIG. 2 is a top view diagram illustrating one embodiment of a textile fastener.

Figure 3:
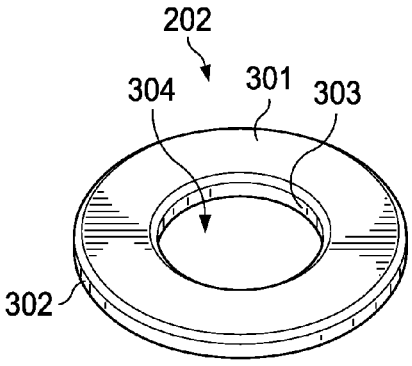

FIG. 3 is a perspective view diagram illustrating one embodiment of a receiving member.

Figure 4:
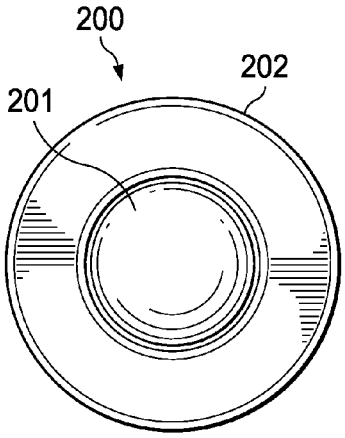

FIG. 4 is a top view diagram illustrating one embodiment of a textile fastener in a pegged configuration.

Figure 5:
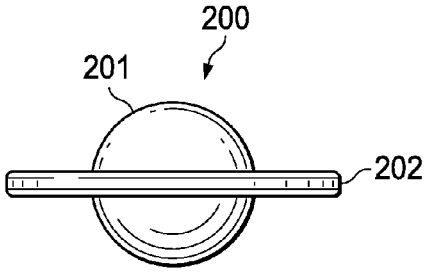

FIG. 5 is a side view diagram illustrating one embodiment of a textile fastener in a pegged configuration.

Figure 6:
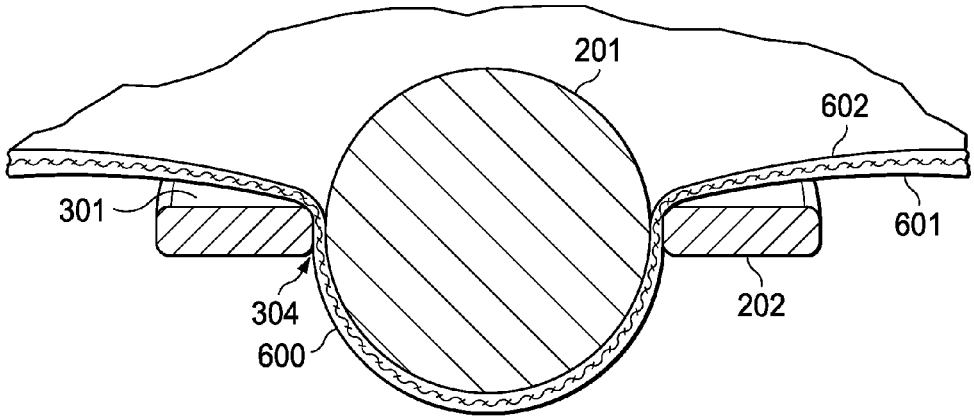

FIG. 6 is a cross-section view diagram illustrating one embodiment of a textile fastener configured to fasten to a textile.

Figure 7:
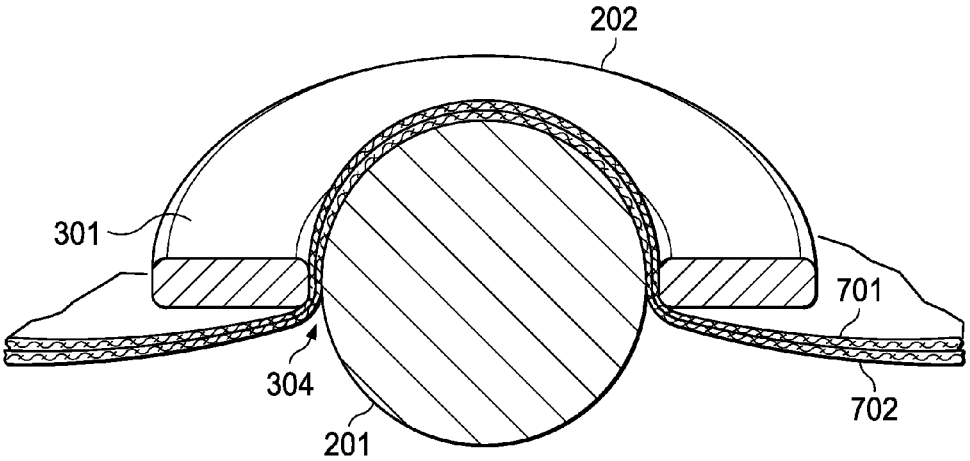

FIG. 7 is a cross-section view diagram illustrating one embodiment of a textile fastener configured to fasten two layers of textile.

Figure 8:
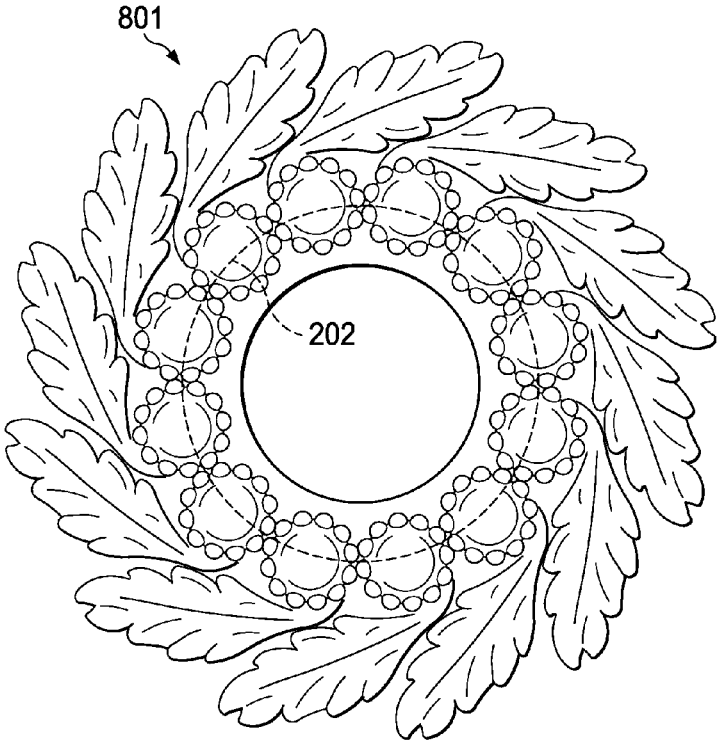

FIG. 8 is a top view diagram illustrating one embodiment of a receiving member having an ornamental structure.

Figure 9:
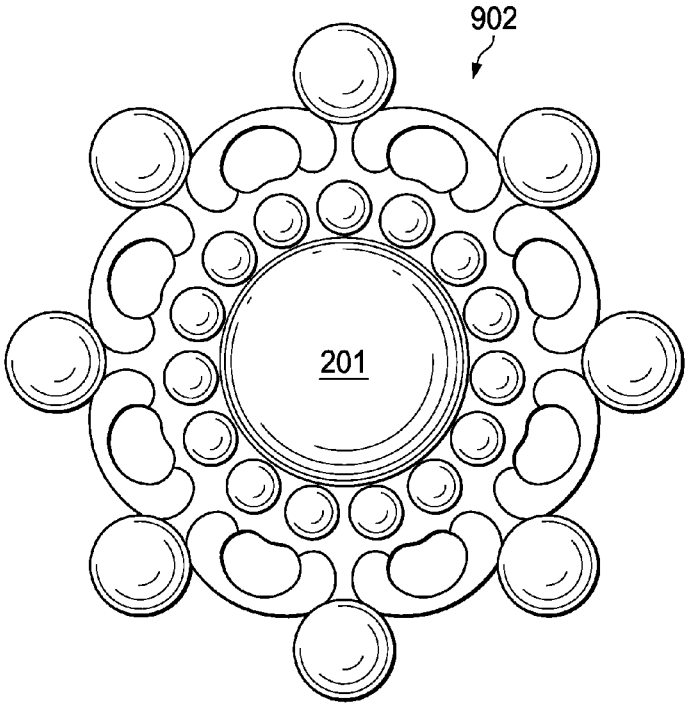

FIG. 9 is a top view diagram illustrating one embodiment of a pegging member having an ornamental structure.

Figure 10:
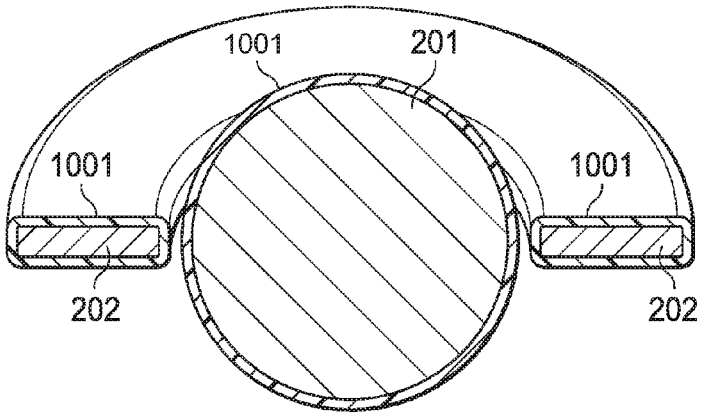

FIG. 10 is a cross-section diagram illustrating one embodiment of a textile fastener having protective coatings.

Figure 11:
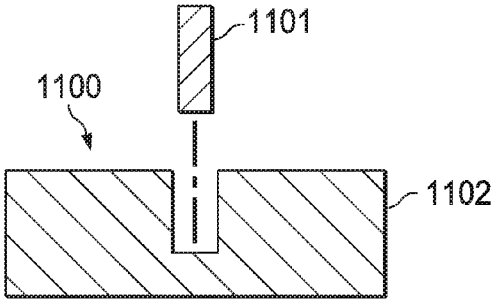

FIG. 11 is a cross-section diagram illustrating another embodiment of a textile fastener.

Figure 12:
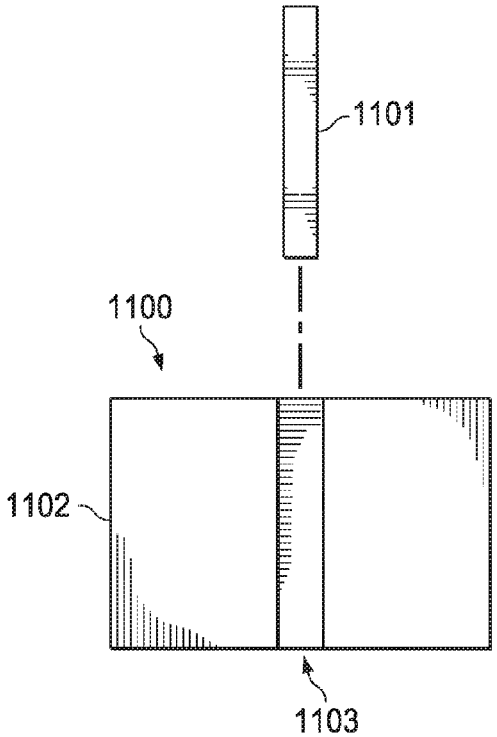

FIG. 12 is a top view diagram illustrating another embodiment of a textile fastener.

Figure 13:
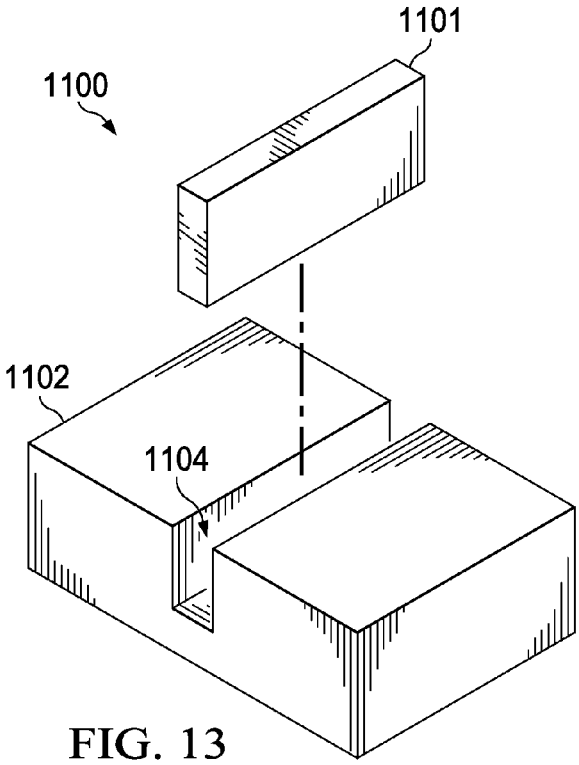

FIG. 13 is a perspective view diagram illustrating another embodiment of a textile fastener.

Figure 14:
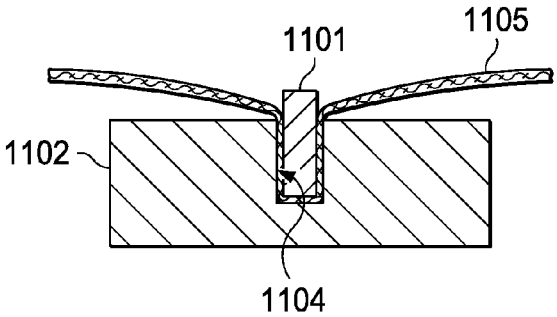

FIG. 14 is a cross-section diagram illustrating use of another embodiment of a textile fastener for fastening a textile.

Figure 15:
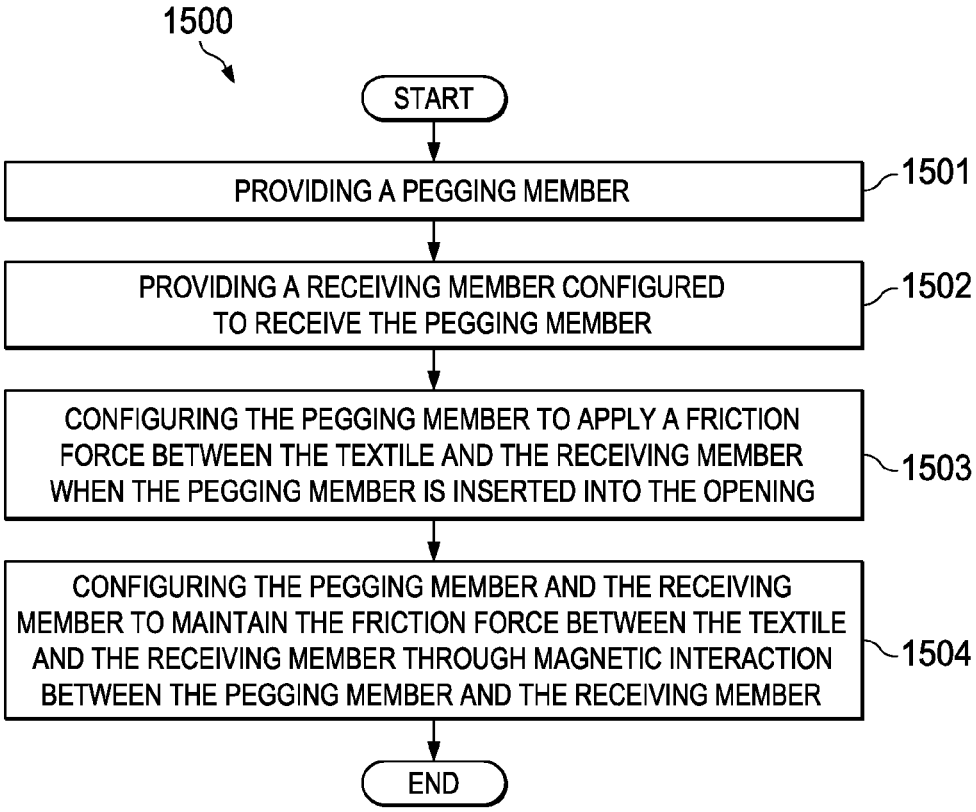

FIG. 15 is a flow-chart diagram illustrating one embodiment of a method for using a textile fastener.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

FIG. 1 is an illustration of a textile 101 with a textile fastener 102. As illustrated, the textile 101 may be a scarf. In other embodiments, the textile 101 may be a wrap, shirt, dress, skirt, sarong, or any number of other articles of clothing. In other embodiments, the textile may be a window covering, a furniture covering, a towel, or any of a variety of other textiles 101. The textile may be made by weaving, knitting, crocheting, knotting or pressing natural or artificial fibers together. In a further embodiment, the term textile may be extended to include latex, vinyl, leather, and other sheets of material. Various embodiments of the textile fastener 102 are discussed in the figures that follow. In the depicted embodiment, the textile fastener 102 includes an ornamental element. For example, the ornamental element may be a design printed on a fabric and coupled to the textile fastener.

FIG. 2 is a top view diagram illustrating one embodiment of a textile fastener 200. In the depicted embodiment, the textile fastener 102 includes a receiving member 202 and a pegging member 201. In one embodiment, the receiving member 202 is magnetic. In some embodiments the pegging member 201 may be magnetic. In further embodiments, both the receiving member 202 and the pegging member 201 are magnetic. Alternatively, only one of the pegging member 201 or the receiving member 202 is magnetic. In such embodiments, the non-magnetic member comprises a magnetically reactive material, such as iron or other ferrous material. For example, if the pegging member 201 is magnetic, the receiving member 202 may have a steel or iron component. If the receiving member 202 is magnetic, then the pegging member 201 may be reactive to magnetic fields, and so on. One of ordinary skill in the art will recognize a variety of magnetic materials that may be suitable for use with the present embodiments. In one embodiment, strong permanent magnets made from alloys of rare earth elements are used. Similarly, one of ordinary skill in the art will recognize a variety of materials that are reactive to magnetic fields that may be suitable for use with the present embodiments.

The receiving member 202 and the pegging member 201 may each be configured in various shapes and arrangements. For example, the receiving member 202 may be a disk as illustrated in FIG. 2. The receiving member 202 may include an opening 304 in the disk as shown in FIG. 3. The opening 304 may be a hole through the surface 301 of the disk. Alternatively, the opening 304 may be a concave recess in the surface 301 of the disk. In such embodiments, the pegging member 201 may be a sphere or cylinder configured to fit through the opening 304. In a particular embodiment, the diameter of the pegging member 201 may be slightly smaller than the diameter of the opening 304, thus allowing space for one or more layers of textile 201 between an edge 303 of the opening 304 and a surface of the pegging member 201.

In the embodiment shown in FIG. 3, the receiving member 202 may include an outer edge 302 and an inner edge 303, wherein the inner edge 303 defines the opening 304. In such an embodiment, the inner edge 303 and the outer edge 302 may be concentric circles. One of ordinary skill in the art may recognize alternative geometries which may be suitable for use with the present embodiments. For example, the opening 304 may be rectangular, square, octagonal, hexagonal, oval, or the like. Thus, the opening 304 may be configured to receive a pegging member having any number of cross-section geometries.

FIG. 4 is a top view diagram illustrating one embodiment of a textile fastener 200 in a pegged configuration. As illustrated, the pegging member 201 may be inserted into the opening 304 of the receiving member 202. In such an embodiment, the receiving member 202 may be disk shaped as illustrated in FIG. 3. The pegging member 201 may be spherical or ball shaped as shown in FIG. 2.

In a further embodiment, the pegging member 201 may be magnetic. For example, the pegging member 201 may be a magnet made from rare earth alloys. The magnet may be formed in a spherical shape. In another embodiment, the magnet may be formed in a cylindrical shape. One of ordinary skill in the art may recognize alternative embodiments of the pegging member 201. In such an embodiment, the magnetic field produced by the magnetic pegging member 201 may interact with the receiving member 202 holding the pegging member 201 in place relative to the receiving member 202.

In other embodiments, the receiving member 202 may be magnetic, and the pegging member 201 may be held in place by the magnetic field produced by the receiving member 202. In still further embodiments, both the pegging member 201 and the receiving member 202 may be magnetic.

FIG. 5 is a side view diagram illustrating one embodiment of a textile fastener 200 in a pegged configuration. As illustrated, the pegging member 201 may be received through the opening 304 of the receiving member 202. In one embodiment, the pegging member 201 may protrude partially from both sides of the receiving member 202.

FIG. 6 illustrates how such a configuration may be used for clasping or pegging the textile 101 between the receiving member 202 and the pegging member 201. FIG. 6 is a cross-section view diagram illustrating one embodiment of a textile fastener 200 configured to fasten to a textile 600. The textile may have a first side 601 and a second side 602. In one embodiment, a portion of the textile 600 may be placed over the opening 304 of the receiving member 202. The first side 601 of the textile 600 may be placed adjacent to the surface 301 of the receiving member 202. The pegging member 201 may be placed adjacent to the second side 602 of the textile 101 and inserted into the opening 304 of the receiving member 202. In such an embodiment, a friction force may be exerted on the textile 600 by the pinching or pegging of the textile 600 between the pegging member 201 and the receiving member 202. The friction force may be maintained by the magnetic interaction between the pegging member 201 and the receiving member 202, where at least one of the two members is magnetic.

FIG. 7 is a cross-section view diagram illustrating one embodiment of a textile fastener 200 configured to fasten two textile layers. The depicted embodiment illustrates a first layer 701 of textile and a second layer 702 of textile. In one embedment, the first layer 701 may be placed over the second layer 702. Either the first layer 701 or the second layer 702 may be placed adjacent the opening 304. The pegging member 201 may then be inserted into the opening 304 thereby pegging both the first layer 701 and the second layer 702 between the pegging member 201 and the receiving member 202.

FIG. 8 is a top view diagram illustrating one embodiment of a receiving member 202 having an ornamental structure 801 attached. In various embodiments, the ornamental structure 801 may be coupled or attached to the receiving member 202. For example, the ornamental structure 801 may be glued, soldered, welded, or otherwise coupled to the receiving member 202. In a further embodiment, the ornamental structure 801 may be integral with the receiving member 202. The ornamental structure 801 may include jewels, engraved metal, fabric, feathers, and various other ornamental materials. In one embodiment, the ornamental structure 801 may take the form of a brooch, flower, animal, or various other ornamental designs. The shape and configuration of the ornamental structure 801 may be adapted to cover all, some, or none of the receiving member so that the receiving member 202 may or may not be visible.

FIG. 9 is a top view diagram illustrating one embodiment of a pegging member 201 having an ornamental structure 901. The ornamental structure 901 may be formed around or on top of the pegging member 201. At least a portion of the pegging member 201 may be configured to protrude from the ornamental structure 901 such that it may be inserted into the opening of a receiving member 202. The shape and configuration of the ornamental structure 901 may be adapted to cover all, some, or none of the receiving member so that the pegging member 201 may or may not be visible.

One of ordinary skill in the art will recognize a variety of different designs and configurations of ornamental structures 801 and 901 that may be used in accordance with the present embodiments.

FIG. 10 is a cross-section diagram illustrating one embodiment of a textile fastener 200 having a protective coating 1001. In one embodiment, the protective coating 1001 may be formed around the pegging member 201. In another embodiment, the protective coating 1001 may be formed around the receiving member 202. In certain embodiments, the protective coating 1001 may be formed around both the pegging member 201 and the receiving member 202. The protective coating 1001 may including a material that is configured to enhance the grip or friction force between the textile 101, the pegging member 201 and the receiving member 202. The protective coating 1001 may include rubber, plastic, or other materials.

FIG. 11 is a cross-section diagram illustrating another embodiment of a textile fastener 1100. In one embodiment, the pegging member 1101 and receiving member 1102 may have an alternative geometric configuration. For example, as illustrated, the receiving member 1102 may have a substantially rectangular cross-section. In such an embodiment, the opening 1103 may be a slot formed in a body portion of the receiving member 1102.

Similarly, the pegging member 1101 may have an alternative geometric cross-section. For example, the pegging member 1101 may have a rectangular cross-section. FIGS. 12-13 further illustrate such an embodiment. As shown in FIG. 12, the pegging member 1101 may have a length that is greater than its width. Similarly, the opening 1103 may be a slot in a surface of the receiving member 1102. The pegging member 1101 may be configured to be received in the slot forming opening 1104.

As shown in FIG. 14, the textile 1105 may be pegged or retained by the pegging member 1101 when it is inserted into the slot opening 1104. In such an embodiment, the friction force securing the textile 1105 may be enhanced because of the increased surface area in the area of the opening 1104. One of ordinary skill in the art will recognize various tradeoffs with respect to the configuration of the pegging member 1104 and the receiving member 1102. For example, certain embodiments may provide enhanced friction force, but may provide less magnetic interaction between the pegging member 1101 and the receiving member 1102. On the other hand, certain other configurations may provide less friction force, but may provide enhanced magnetic interaction between the pegging member 1101 and the receiving member 1102.

FIG. 15 is a flow-chart diagram illustrating one embodiment of a method 1500 for using a textile fastener 102. In one embodiment, the method 1500 includes positioning 1501 a first layer of textile adjacent to a receiving member of a textile fastener. In one embodiment, the receiving member may include a flange portion configured to support the first textile layer and a second textile layer, and an opening disposed within the flange portion configured to receive the pegging member. The method 1500 may further include positioning 1502 a second layer of textile adjacent to the first layer of textile. Additionally, the method 1500 may include inserting 1503 a pegging member into the opening, such that the first layer of textile and the second layer of textile are pinned or pegged between the pegging member and the receiving member in the area of the opening. In such an embodiment, the pegging member is configured 1504 to apply a friction force to the receiving member, the first textile layer and the second textile layer for inhibiting movement of the first and second textile layers relative to each other and relative to the receiving member when the pegging member is inserted into the opening. Additionally, magnetic interaction between the pegging member and the receiving member is configured to maintain the friction force on the first layer of textile, the second layer of textile and the receiving member.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

What is claimed is:

1. A textile fastener, comprising:

a magnetic spherical member having a first diameter; and a receiving member, the receiving member comprising:

a flange portion configured to support at least a portion of a textile; and a hole within the flange portion, the hole having a second diameter larger than the first diameter so that the magnetic spherical member is passable entirely through the hole, the spherical member and the hole configured to apply a friction force between at least two textile layers and the receiving member when the magnetic spherical member is inserted into the hole, and wherein magnetic interaction between the spherical member and the receiving member maintains the magnetic spherical member within the hole in the receiving member.

2. The textile fastener of claim 1, wherein the receiving member is magnetic.

3. The textile faster of claim 1, wherein the receiving member comprises a disk.

4. The textile fastener of claim 1, wherein the receiving member further comprises:

an outer edge; and an inner edge, the inner edge being concentric with the outer edge and defining the second diameter.

5. The textile fastener of claim 1, further comprising an ornamental structure coupled to the magnetic spherical member or the receiving member.

6. A textile fastener comprising:

a spherical member; and a receiving member, the receiving member comprising:

a flange portion; and a hole within the flange portion configured to receive the spherical member and having a second diameter larger than a first diameter so that the spherical member is passable entirely through the hole;

wherein a gap between the spherical member and the receiving member is accepts a first textile layer and a second textile layer; and wherein magnetic interaction between the spherical member and the receiving member maintains the spherical member within the hole to inhibit movement of the first and second textile layers relative to each other and relative to the receiving member by applying a friction force on the first layer of textile, the second layer of textile, and the receiving member.

7. The textile fastener of claim 6, wherein the receiving member is magnetic.

8. The textile fastener of claim 6, wherein the spherical member is magnetic.

9. The textile faster of claim 6, wherein the receiving member comprises a disk.

10. The textile fastener of claim 6, wherein the receiving member further comprises:

an outer edge; and an inner edge, the inner edge being concentric with the outer edge and defining the second diameter.

11. The textile fastener of claim 6, further comprising an ornamental structure coupled to the spherical member or the receiving member.

12. The textile fastener of claim 6, wherein a portion of the friction force is maintained by pinching the first textile layer and second textile layer between the spherical member and the receiving member.

13. A fastener comprising:

a magnetic sphere having a first diameter;

a non-magnetic metal disk having a hole in a center of the disk, wherein the hole has a second diameter that is larger than the first diameter to allow the magnetic sphere to pass through the hole, wherein a difference between the first diameter and the second diameter creates a gap between a surface of the magnetic sphere and an inside edge of the hole when the magnetic sphere is fully within the hole, the gap allowing at least two layers of cloth to fit between the surface of the magnetic sphere and the inside edge of the hole when the magnetic sphere is fully within the hole; and wherein magnetic interaction between the sphere and the disk creates a force that pinches the at least two layers of cloth in a fixed relative position.

* * * * *

UNITED STATES PATENT AND TRADEMARK OFFICE

CERTIFICATE OF CORRECTION

PATENT NO. : 9,320,328 B1
APPLICATION NO. : 13/724044
DATED : April 26, 2016
INVENTOR(S) : Margaret A. Sinclair It is certified that error appears in the above-identified patent and that said Letters Patent is hereby corrected as shown below:

Title Page, in the Title (54): delete "TEXTILE FASTNER" and insert --TEXTILE FASTENER--.

Signed and Sealed this
Nineteenth Day of July, 2016

Michelle K. Lee

Michelle K. Lee
*Director of the United States Patent and Trademark Office*